United States Patent [19]

Ranzanigo

[11] 4,081,779

[45] Mar. 28, 1978

[54] HOUSING INSERT FOR RECEPTABLE SEAT

[75] Inventor: Pierluigie Ranzanigo, Brescia, Italy

[73] Assignee: Bassani Ticino S.p.A., Milan, Italy

[21] Appl. No.: 715,326

[22] Filed: Aug. 18, 1976

[30] Foreign Application Priority Data

Sep. 18, 1975 Italy ..... 27375/75

[51] Int. Cl.[2] ..... H01R 33/06

[52] U.S. Cl. ..... 337/198; 337/201; 337/226

[58] Field of Search ..... 335/202; 337/20, 34, 337/187, 198, 201, 208, 209, 225, 226, 260, 262, 264; 339/184 R, 186 R

[56] References Cited

U.S. PATENT DOCUMENTS

| | | | |
|---|---|---|---|
| 1,011,232 | 12/1911 | Müller | 337/226 |
| 1,832,194 | 11/1931 | Esser | 337/225 X |
| 2,204,948 | 6/1940 | Pond | 337/226 |
| 2,206,787 | 7/1940 | Linton | 337/226 |
| 3,815,072 | 6/1974 | Di Marco et al. | 337/209 X |
| 3,833,875 | 9/1974 | Holoka | 337/187 X |

FOREIGN PATENT DOCUMENTS

| | | | |
|---|---|---|---|
| 1,963,648 | 6/1971 | Germany | 337/201 |
| 79,163 | 9/1931 | Sweden | 339/186 R |
| 301,062 | 12/1929 | United Kingdom | 337/226 |

*Primary Examiner*—A. D. Pellinen
*Attorney, Agent, or Firm*—Michael J. Striker

[57] ABSTRACT

An electrical device, in particular a fuse, circuit breaker or the like, comprises a housing having extending therefrom a projection, together with two conductive pins for connecting the device to an external circuit. A receptacle for accommodating the device has a wall provided with a seat and also with two holes through which the device pins pass when the device is inserted in the receptacle. A fitting is releasably accommodated in the seat and is able to accommodate the entrance therein of the projection to enable the device to be fully inserted. If an attempt is made to insert in the receptacle a different device provided with a projection that cannot enter the recess in the seat, the device cannot be fully inserted. However, the receptacle can be conditioned to accept the different device by inserting in the seat a different fitting having a different recess which will accommodate entrance of the projection of the different fitting. Fuses or circuit breakers of different current ratings are provided with projections of different shapes and/or sizes, whereby a receptacle provided with a particular seat will accommodate fuses or circuit breakers of a current rating equal to or greater than a value corresponding to that seat, but will not accept fuses or circuit breakers having a current rating less than that value.

5 Claims, 4 Drawing Figures

HOUSING INSERT FOR RECEPTABLE SEAT

BACKGROUND OF THE INVENTION

1. Field of the invention

This invention relates to an electrical device and a receptacle for accommodating the device. The invention is particularly, but not exclusively, concerned with electrical circuit protection devices such as fuses, circuit breakers or the like.

2. Description of the prior art

Electrical circuit protection devices such as cartridge fuses and circuit breakers that are designed to be mounted in respective receptacles by insertion of pins must provide predetermined breaking characteristics depending upon the nominal current carried by an associated electrical circuit. To properly protect an associated electrical circuit, a particular circuit protection device should not be interchangeable (or at least should have a limited degree of interchangeability) with other devices having different breaking characteristics.

Known techniques of preventing such interchangeability suffer from the disadvantage that they require differently sized electrical devices and differently sized respective receptacles therefor. This means that the manufacturer must establish a very large and expensive production facility for producing a range of devices and receptacles of different sizes, so that production costs are high. Further, installers have to stock a large number of different, very expensive devices and receptacles, which necessitates a large capital investment.

SUMMARY OF THE INVENTION

The present invention has the object of preventing the above-outlined disadvantages of the prior art by providing electrical devices of which the internal structures vary in accordance with their respective nominal currents, the nominal currents lying within a large range, the control of interchangeability among the electrical devices having different nominal currents and different breaking characteristics being provided by means of simple accessories, the cost of which is unappreciable with respect to the cost of the electrical devices.

The present invention comprises an electrical device provided with two parallel conductive pins for its electrical connection to an external circuit and a projection extending from a housing of the electrical device and preferably interposed between said conductive pins, and a receptacle having a recess capable of accommodating the housing of the electrical device, the receptacle having a bottom wall provided with two holes through which the connecting pins can be passed, and a seat positioned between the two holes and capable of receiving a fitting having a recess capable of accommodating said projection from the housing of the electrical device.

If an attempt is made to insert in the receptacle a different device provided with a projection that cannot enter the recess in the seat, the device cannot be fully accommodated in the receptacle. However, the receptacle can be conditioned to accept the different device by replacing the fitting with a different fitting having a different recess which will accommodate entrance of the projection of the different fitting.

A whole range of electrical devices of different nominal currents and of the same basic size and shape can be produced by a single manufacturing facility, the projections of the different devices having sizes and/or shapes corresponding to their respective nominal currents. A range of fittings having recesses of different sizes and/or shapes can be produced, all of the fittings being capable of being fitted within the seat in the receptacle. The installer will fit in the seat of a receptacle a fitting corresponding to the nominal current of a device intended to be accommodated in the receptacle. In the way a particular receptacle can be conditioned to receive only a device of a particular nominal current, or, as is described in more detail hereinbelow, only a device having a particular nominal current or a device having a nominal current greater than the particular nominal current.

BRIEF DESCRIPTION OF THE DRAWING

The invention will now be further described, by way of example, with reference to the accompanying drawing, wherein.

DETAILED DESCRIPTION OF THE PREFERRED EMBODIMENTS

Figure 1:
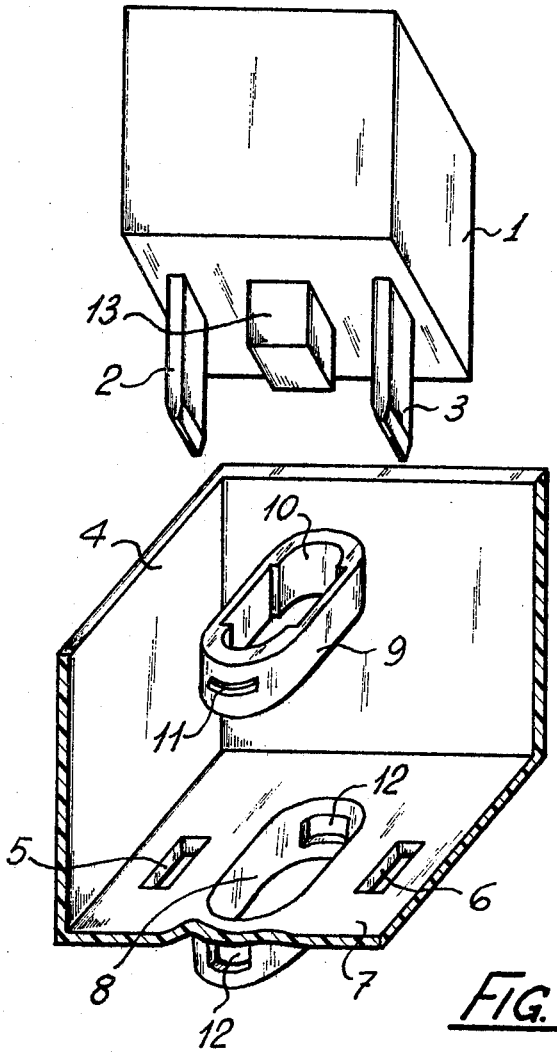
FIG. 1 is an exploded perspective view of an electrical device and receptacle in accordance with the invention.

Referring now to FIG. 1 reference numeral 1 designates an electrical device that may be a cartridge fuse, a circuit breaker, an electrical socket or the like. The device 1 is provided with two parallel conductive pins 2 and 3 extending from a housing thereof. The housing is shown as being of a parallelepipedal shape, but may be of a different shape.

A projection 13 extends from the housing of the device 1 between the conductive pins 2 and 3. The shape of the projection 13 may be different from the parallelepipedal shape shown in FIG. 1.

A receptacle 4 is designed to accommodate the electrical device 1 and is provided with a bottom wall 7 wherein two spaced holes 5 and 6 are formed for passage therethrough of the conductive pins 2 and 3 to connect the pins to conductive member (not shown) disposed under the bottom wall 7 and connected to an electrical circuit.

An elongate seat 8 is formed in the bottom wall 7 between the holes 5 and 6. The seat 8 is designed to accommodate a fitting 9. The outer form of the fitting 9 corresponds to the shape of the seat 8. The fitting 9 is provided with an upwardly opening recess 10.

The fitting 9 has ribs 11 provided on its ends so that upon insertion of the fitting 9 into the seat 8 the ribs 11 snap under the upper edges of respective holes 12 formed in end walls of the seat 8, whereby the fitting is snap fitted into the seat.

The recess 10 of the fitting 9 is of such a size and shape as to allow insertion therein of the projection 13.

A plurality of the devices 1, each having a respective different nominal current, can be produced. The different devices 1 will have substantially the same external configuration, except for their projections 13. The projections 13 will have respective different sizes and/or shapes corresponding to the nominal currents of the associated devices.

Also, a plurality of diferent fittings 9 can be produced. The different fittings 9 can be of substantially the same outer form so that any one of them can be fitted in the seat 8, but their recesses 10 will be differently sized and/or shaped. Upon installation, the installer will fit into the seat 8 of a receptacle 4 a fitting 9 which has a recess 10 which will allow entrance therein of the projection 13 of a device 1 having a nominal current equal to that required by the electrical circuit connected to the receptacle 4. The sizes and/or shapes of the various projections 13 and recesses 10 are so chosen that a particular fitting 9 will accept not only the projection 13 of a device 1 having the nominal current of the electrical circuit but also the projection 13 of a device 1 having a nominal current greater than that of the electrical circuit. However, a particular fitting 9 will not accommodate entrance therein of the projection 13 of a device 1 having a nominal current less than that of the electrical circuit.

Figure 2:
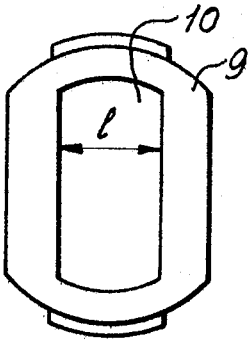
FIGS. 2, 3 and 4 are top plan views of different fittings corresponding to different nominal currents and which can be fitted in a seat in the receptacle shown in FIG. 1.

An example of one shape that may be imported to the recesses 10 of the different fitting 9 is shown in FIG. 2. In this case the recess 10 has two opposed longer sides which are parallel to each other and two opposed shorter arcuate sides. The recesses 10 of the different fittings 9 may be provided with different widths *l*, the different widths corresponding to different nominal currents for the electrical circuit. The projections 13 of the different devices 1 are shaped and/or dimensioned in such a manner that in a particular recess 10 corresponding to a prescribed nominal current there may be inserted both a projection 13 corresponding to the same nominal current or projections 13 corresponding to a greater nominal current. However, no projection 13 corresponding to a lesser nominal current may be inserted, because in this event the projection would have a width larger than the width *l* of the recess 10.

By way of example, assuming that the width *l* of a particular recess 10 corresponds to a nominal current of 80 A, the recess 10 will accommodate entrance of a projection member 13 of a device 1 having a nominal current of 80 A and also the projection 13 of a device 1 having a nominal current of 100 A, but will not accommodate entrance of the projection 13 of a device having a nominal current of 63 A.

Figure 3:
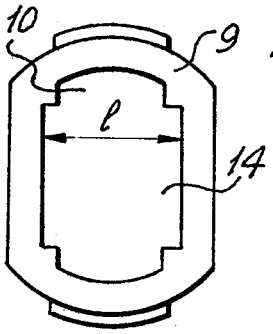

In the case of the fitting 9 shown in FIG. 3, the recess 10 corresponds to that shown in FIG. 12 intersected by a recess 14 of square section, the sides of which may be varied between different fittings in accordance with the corresponding nominal currents. Accordingly, the projections 13 will each have a square section, as shown in FIG. 1.

Figure 4:
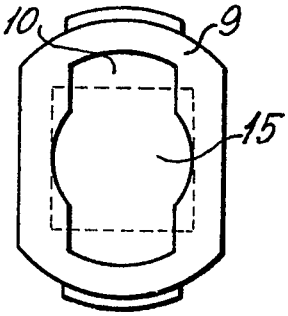

In the case of the fitting 9 shown in FIG. 4 the recess 10 corresponds to that shown in FIG. 2 intersected by a recess 15 of circular section, the latter being provided with different diameters for different fittings, each diameter corresponding to a respective nominal current. In this event the projections 13 will each have a circular section.

By varying the shaping of the recess 10, different ranges of nominal currents may be selected, each range corresponding to an associated shaping of the recess 10. By way of example, the shape of the recess 10 shown in FIG. 2 may be used in a nominal current range of from 5 to 32 A, the shape of the recess of FIG. 4 in a range of from 32 to 63 A, and the shape of the recess of FIG. 3 in the range of from 63 to 100 A.

I claim:

1. An electrical device associatable with an electrical circuit, comprising a plurality of housings each provided with two conductive pins projecting substantially parallel from a respective housing, and a projection projecting from said housing and located between said conductive pins, the different housings corresponding to different nominal currents of the electrical circuit and having projections of different sizes; a receptacle having two holes each adapted for passing a respective one of said pins of each of said housings therethrough, said receptacle also having a central seat located between said holes; and a plurality of fittings each insertable into said seat of said receptacle and having a central recess, an outer contour of each of said fittings corresponding to the contour of said seat of said receptacle, the different fittings having recesses of different sizes each corresponding to the size of the projection of a respective housing so that, when one of said fittings is inserted into said seat of said receptacle only such a one of said housings can be mounted in said receptacle whose projection has a size corresponding to the size of the recess of the thus-inserted fitting, whereby a predetermined nominal current of the electrical circuit is assured.

2. The device as defined in claim 1, wherein each of said fittings is snap insertable into said seat.

3. The device as defined in claim 1; and further comprising means responsive to a current of greater than a predetermined value flowing through said electrical circuit to open said circuit.

4. The device as defined in claim 1, wherein each of said fittings has outwardly projecting ribs, said receptacle having slots associated with said seat and each adapted to receive a respective rib of each of said fittings with snap action.

5. An electrical device associatable with an electrical circuit, comprising at least two pluralities of housings each provided with two conductive pins projecting substantially parallel from a respective housing, and a projection projecting from said housing and located between said conductive pins, the housings of different ones of said pluralities corresponding to nominal currents of the electrical circuit within the different ranges and having projections of different shapes, the different housings of a respective one of said pluralities corresponding to the different nominal currents of the electrical circuit within a respective current range and having projections of different sizes; a receptacle having two holes each adapted for passing a respective one of said pins of said housings therethrough, said receptacle also having a central seat located between said holes; and at least two pluralities of fittings each insertable into said seat of said receptacle and having a central recess, an outer countour of each of said fittings corresponding to the contour of said seat of said receptacle, the fittings of different ones of said pluralities having recesses of different shapes each corresponding to the shapes of the projections of the respective plurality of said housings, the different fittings of a respective one of said pluralities of fittings having recesses of different sizes corresponding to the sizes of the projections of the different housings of a respective plurality so that, when one of said fittings is inserted into said seat of said receptacle only such a one of said housings can be mounted in said receptacle whose projection has a shape and also a size corresponding to the shape and the size of the recess of the thus-inserted fitting, whereby a predetermined nominal current of the electric circuit is assured.

* * * * *